US007313885B1

(12) United States Patent
Looney

(10) Patent No.: US 7,313,885 B1
(45) Date of Patent: Jan. 1, 2008

(54) ALIGNMENT DEVICE FOR TELESCOPIC SIGHT MOUNTS

(76) Inventor: James F. Looney, 2728 Brockton Rd., Jefferson, GA (US) 30549

( * ) Notice: Subject to any disclaimer, the term of this patent is extended or adjusted under 35 U.S.C. 154(b) by 0 days.

(21) Appl. No.: 11/227,833

(22) Filed: Sep. 14, 2005

Related U.S. Application Data

(60) Provisional application No. 60/610,312, filed on Sep. 16, 2004.

(51) Int. Cl.
*F41G 1/38* (2006.01)

(52) U.S. Cl. ..... 42/125; 33/645

(58) Field of Classification Search ..... 42/119, 42/120, 124, 125, 126, 135, 136, 137; 33/645, 33/533
See application file for complete search history.

(56) References Cited

U.S. PATENT DOCUMENTS 3,782,832 A * 1/1974 Hacskaylo ..... 356/153
4,095,347 A * 6/1978 Steffan ..... 42/121
4,825,258 A * 4/1989 Whitson ..... 356/153
5,033,219 A * 7/1991 Johnson et al. ..... 42/115
5,813,131 A 9/1998 Werre
D456,479 S 4/2002 Peterson
6,397,509 B1 * 6/2002 Langner ..... 42/116
6,499,247 B1 * 12/2002 Peterson ..... 42/116
6,584,720 B1 * 7/2003 Johnson ..... 42/120
6,598,331 B1 * 7/2003 Thibodeaux ..... 42/111
6,931,778 B1 * 8/2005 Nelson et al. ..... 42/120
2002/0162267 A1 * 11/2002 Nelson et al. ..... 42/120

* cited by examiner

*Primary Examiner*—Michael J. Carone
*Assistant Examiner*—Benjamin P. Lee
(74) *Attorney, Agent, or Firm*—Kenneth S. Watkins, Jr.

(57) ABSTRACT

An alignment device for telescopic sight mounts (101) utilizes a front alignment portion (103) and a rear alignment portion (105) installed on a firearm 405. A front bushing (109), clamped in a front mount assembly (401) of the firearm provides a precision sliding fit with a front alignment rod (107). A rear bushing (113), clamped in a rear mount assembly (403) of the firearm provides a precision sliding fit with a rear alignment rod (107). Acceptable alignment of the front and rear mount assemblies is indicated by full engagement of a male indicator portion (115) of the front alignment rod and a female indicator portion (117) of the rear alignment rod when the respective rods are slideably engaged. A bore sight engagement element (151) allows bore sighting of the mounts with the rifle bore (425).

22 Claims, 6 Drawing Sheets

ALIGNMENT DEVICE FOR TELESCOPIC SIGHT MOUNTS

This application claims the priority of U.S. Provisional Application No. 60/610,312 filed Sep. 16, 2004.

FIELD OF THE INVENTION

The present invention relates to devices to aid in the alignment of mounts for telescopic sights, and more particularly, devices to aid in the alignment of ring-type rifle and handgun telescopic mounts.

BACKGROUND OF THE INVENTION

Accurate sighting and adjustment of the gun sights, especially telescopic sights, is especially critical for long-range sport and competitive shooting. In long range shooting, even very minor variations in gun or cartridge setup can make a significant difference in bullet location, so it is especially important for the equipment used to be stable and produce consistent results every time the gun is fired.

Good alignment of telescopic sight mounts is important, not only between front and rear mounts themselves, but between the mounts and the rifle bore of the firearm. Good alignment of the rifle bore is important so that the telescopic sight crosshairs will remain centered in the optics, necessary for good optical performance of the scope. Good alignment of the front and rear mounts is necessary to prevent undue mechanical stresses in the telescopic sight. Such stresses will affect the accuracy of the sight, and may result in damage to the optics or mechanical parts of the telescopic sight. Such stresses will also result in sight changes with time or when subjected to vibration or handling.

U.S. Pat. No. 5,813,131 discloses a pair of telescopic sight mount aligning bars. The bars have a circular end which reveals mount misalignment when clamped in the mount by non-parallelity between the inner ends. While this type of device is useful, it requires subjective evaluation to determine proper scope alignment. It is also relatively difficult and time consuming to mount and remount the bars after adjustments are made to recheck alignment. Also, the device lacks a "go/no-go" method to test whether alignment is sufficient.

There exists a for an alignment device for telescopic sight mounts which is quick and simple to use, and addresses shortcomings of previous devices.

OBJECTS AND SUMMARY OF THE INVENTION

Therefore, an object of the present invention is to provide an alignment device for telescopic sight mounts that provides an objective determination of adequate mount alignment to protect the telescopic sight from excessive mechanical stresses and damage.

Another object of the present invention is to provide an alignment device for telescopic sight mounts that provides a "go/no-go" alignment check feature.

Another object of the present invention is to provide an alignment device for telescopic sight mounts that quickly engages or disengages to check alignment between the front and rear mounts of a telescopic sight.

Yet another object of the present invention is to provide an alignment device for telescopic sight mounts that provides a means for bore sighting the telescopic sight mounts.

Still another object of the present invention is to provide an alignment device for telescopic sight mounts that utilizes a bore sight apparatus having a muzzle bore engagement element for bore sighting the telescopic mounts.

The alignment device for telescopic sights utilizes a front alignment portion and a rear alignment portion. Both the front and rear alignment portions comprise a bushing clamped in standard telescopic mount rings and an alignment rod having a precision sliding fit with the bushing. The front and rear alignment rods comprise alignment indicator portions that, in the preferred embodiments, are precision male and female coupling or engagement ends. In one embodiment, the front alignment rod is a reduced-diameter cylindrical portion forming a male engagement element and a cylindrical aperture in the rear alignment rod forming a female engagement element.

By selection of the tolerances of the alignment rod-bushing sliding fit and the male-female engagement elements, an objective "go/no-go" alignment check can be made quickly by sliding the front and rear alignment rods together and checking for engagement of the male and female engagement elements. Determination of the appropriate tolerances for adequate alignment may be calculated or determined empirically. Other male-female engagement elements may be used on the front and rear alignment rods such as conical elements, ball and socket elements, and elements having triangular, square or other multi-sided elements in cross-section.

Another embodiment of the present invention provides a bore sight attachment means such as a bore in one or both of the alignment rods which accepts a bore sight alignment apparatus such as a laser bore sight. The attachment means allows bore sight adjustment of the telescopic sight mounts to align with the rifle bore of the firearm.

Still other embodiments of the invention provide for tapered cone engagement indicators or planar type indicators. These indicators may comprise calibrated marking to show the magnitude of misalignment in excess of an acceptable level to aid in aligning the front and rear mounts.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

Figure 1:
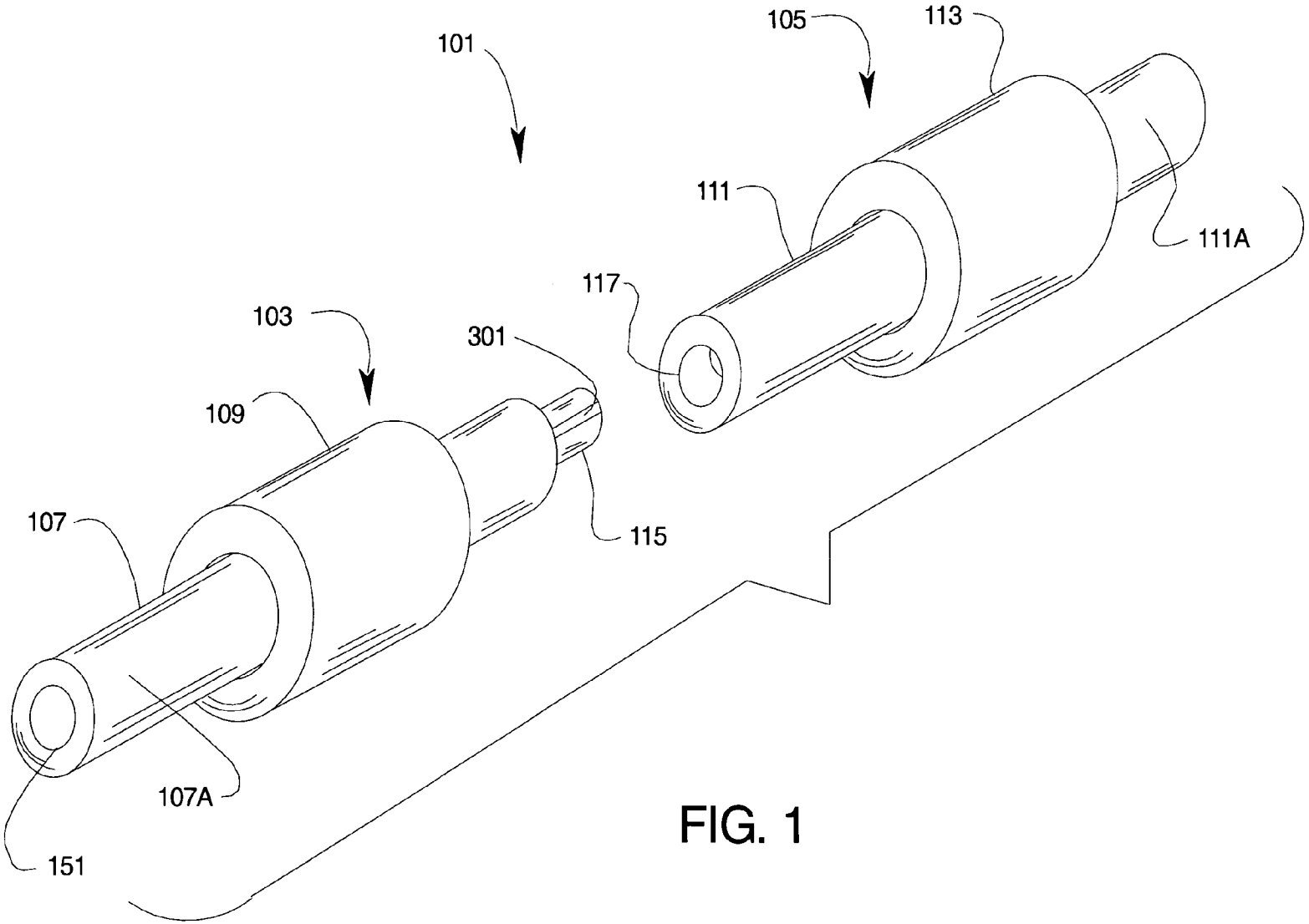
FIG. 1 is a perspective drawing of an embodiment of the alignment device having a front alignment portion consisting of a front alignment bushing and a front alignment rod, and a rear alignment portion consisting of a rear alignment bushing and a rear alignment rod, a reduced-diameter rod portion of the front alignment rod engageable with a cylindrical aperture of the rear alignment rod.

Referring to FIGS. 1-3D, the alignment device 101 comprises a front alignment portion 103 and a rear alignment portion 105. Front portion 103 utilizes a front alignment rod 107 in sliding engagement with front bushing 109. Rear portion 105 utilizes a rear alignment rod 111 in sliding engagement with rear bushing 113. In the preferred embodiments, the entire outer diameter surfaces 107A, 111A are in close sliding contact with the inner diameter of respective bushings 109, 113. In other embodiments, alignment rods 107, 111 are of different cross sectional diameter along its length and only a portion of the outer diameter surface is in close sliding contact with their respective bushings.

In the preferred embodiments, front rod 107 utilizes a first alignment indicator such as reduced-diameter rod portion 115 which forms a close-tolerance fit with a second alignment indicator of rear rod 111 such as cylindrical aperture 117. The close-tolerance fit feature of reduced-diameter rod portion 115 and aperture 117 provides a precise indication of both angular and offset alignment of respective rods 107, 111 when engaged as shown in FIG. 2B. An alignment bore 151 on front alignment rod 107 provides an engagement and alignment means for an alignment sight apparatus such as a laser bore sight as described in the following sections. In the preferred embodiments, alignment bore 151 is drilled axially in the opposite end of alignment rod 107 from the reduced-diameter rod portion 115 and comprises a diameter matching standard firearm muzzle bores. In other embodiments, alignment bore 151 is drilled in both alignment rods 107 and 111.

Figure 2A:
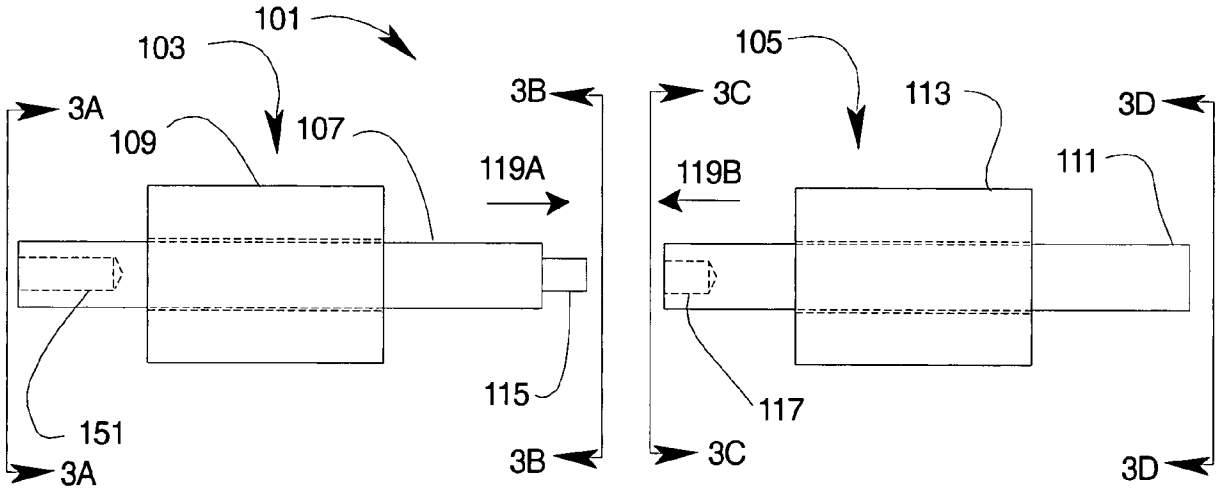
FIG. 2A is a side elevation drawing of the alignment device prior to sliding engagement of the reduced-diameter rod portion of the front alignment rod and the cylindrical aperture of the rear alignment rod.
Figure 2B:
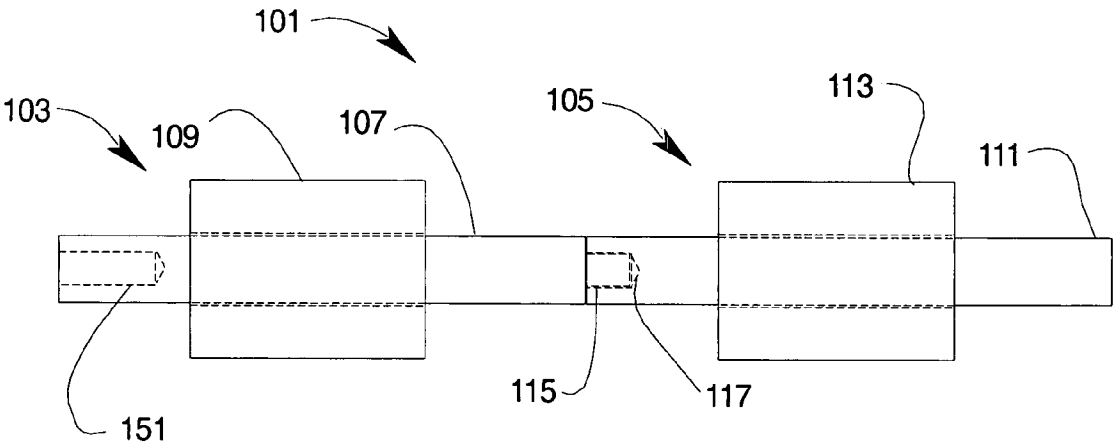
FIG. 2B is a side elevation drawing of the alignment device after engagement of the reduced-diameter rod portion of the front alignment rod and the cylindrical aperture of the rear alignment rod.
Figure 3A:
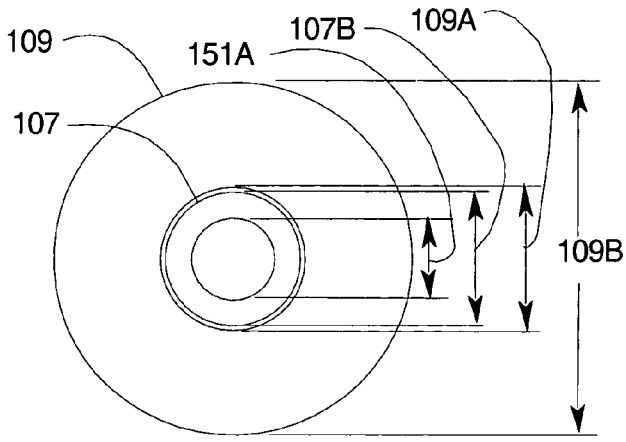
FIG. 3A is an end view of the bore sight attachment end of the front alignment portion taken along lines 3A-3A of FIG. 2A showing the diameters of the alignment bore, the front alignment rod outer diameter, the front bushing inner and outer diameter and the sliding fit between the front alignment rod and the front bushing.

FIG. 3A is an end view of front portion 103 taken along lines 3A-3A of FIG. 2A. The outer diameter 109B of bushing 109 is chosen to be similar to standard telescopic sight barrel diameters so that bushing 109 may be securely clamped by telescopic sight mount assemblies shown in FIG. 4A. In the preferred embodiments, this is typically 1 inch or 30 mm, but may be other diameters used in the art.

In the preferred embodiments, the diametrical clearance between front rod outer diameter 107B and the inner diameter 109A of bushing 109 is less than 0.0020 inches on the diameter. In the more preferred embodiments, the diametrical clearance between front rod diameter 107B and the inner diameter 109A of bushing 109 is less than 0.0015 inches on the diameter. In the still more preferred embodiments, the diametrical clearance between front rod diameter 107B and the inner diameter 109A of bushing 109 is less than 0.0010 inches on the diameter. In the most preferred embodiments, the diametrical clearance between front rod diameter 107B and the inner diameter 109A of bushing 109 is less than 0.0005 inches on the diameter.

In the preferred embodiments, front bushing 109 and rear bushing 113 are identical. Close-fit tolerances of rear alignment rod 111 outer diameter and rear bushing 113 inner diameter are similar. The close-fit tolerance between the alignment rod outer diameter and bushing inner diameter allow forward and backward movement of rods 107, 111 in their respective bushings 109, 113 as shown by arrows 119A, 119B and yet provide accurate alignment testing as explained later.

Figure 3B:
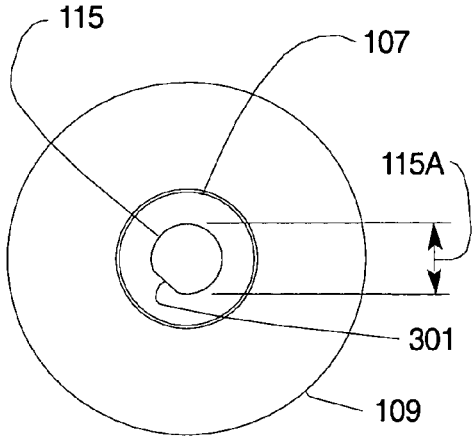
FIG. 3B is an end view of the reduced-diameter end of the front alignment portion taken along lines 3B-3B of FIG. 2A.
Figure 3C:
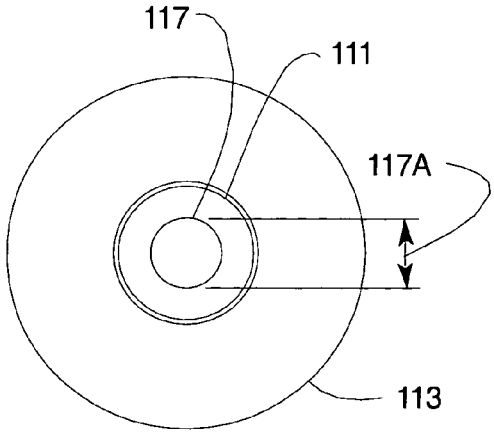
FIG. 3C is an end view of the cylindrical aperture end of the rear alignment portion taken along lines 3C-3C of FIG. 2A.
Figure 3D:
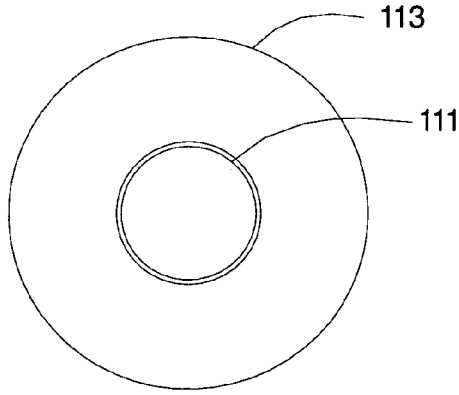
FIG. 3D is an end view of the rear alignment portion taken along lines 3D-3D of FIG. 2A.

In the preferred embodiments, diametrical clearance between the outer diameter of reduced-diameter rod portion 115, shown by 115A of FIG. 3B and the inner diameter of cylindrical aperture 117, shown by 117A of FIG. 3C is less than 0.0020 inches on the diameter. In the more preferred embodiments, the diametrical clearance between the outer diameter of reduced-diameter rod portion 115 and the inner diameter of cylindrical aperture 117 is less than 0.0015 inches on the diameter. In the still more preferred embodiments, the diametrical clearance between the outer diameter of reduced-diameter rod portion 115, and the inner diameter of cylindrical aperture 117 is less than 0.0010 inches on the diameter. In the most preferred embodiments, the diametrical clearance between the outer diameter of reduced-diameter rod portion 115 and the inner diameter of cylindrical aperture 117 is less than 0.0005 inches on the diameter.

In the preferred embodiments, a means to vent cylindrical aperture 117 is provided such as a machined flat 301 on reduced-diameter rod portion 115. In other embodiments, other means to vent aperture 117 is provided such as a vent groove in reduced-diameter rod portion 115 or a through hole between surface 111A of alignment rod 111 and cylindrical aperture 117. Venting is useful due to the close-fit nature of the fit between reduced-diameter rod portion 115 and cylindrical aperture 117, resulting in pneumatic compression when coupling.

Figure 4A:
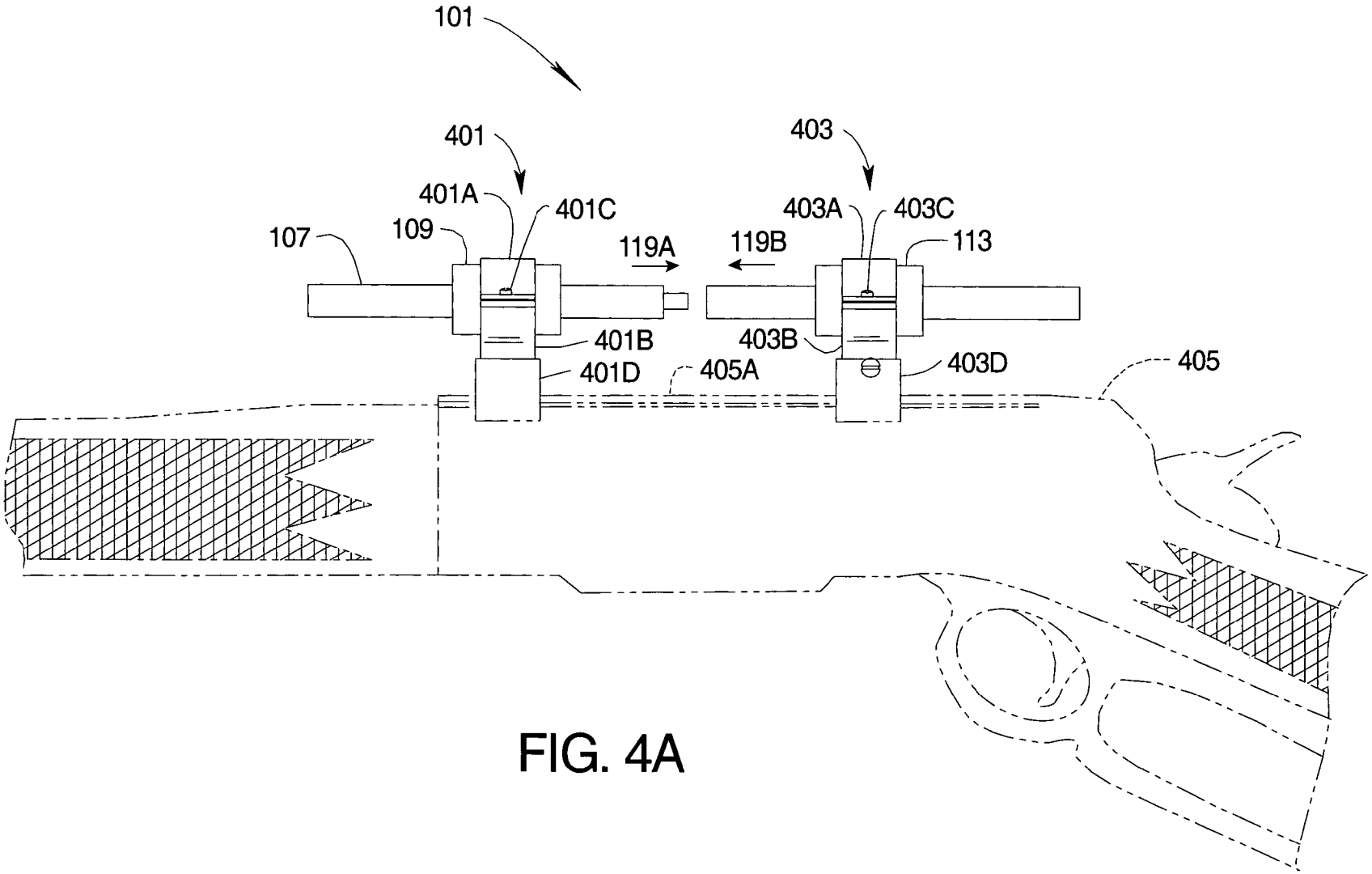
FIG. 4A is a side elevation drawing of the front and rear alignment portions of the device clamped in the respective front and rear telescopic mounts of a rifle shown in phantom lines, and the front and back alignment rods being moved towards engagement by sliding in the respective front and rear bushings.

FIG. 4A is a side elevation drawing of alignment device 101 installed in front mount assembly 401 and rear mount assembly 403 of rifle 405 shown in phantom lines. Front bushing 109 is clamped in place by front ring clamps 401A, 401B and retained by clamp screw 401C. Front mount base 401D attaches ring clamps 401A, 401B to rifle receiver 405A as known in the art. In a similar manner, rear bushing 113 is clamped in place by rear ring clamp portions 403A, 403B and retained by clamp screw 403C. Rear mount base 403D attaches ring clamp portions 403A, 403B to rifle receiver 405A as known in the art.

When testing alignment of the telescopic mount, front alignment rod 107 is inserted into front bushing 109 and rear alignment rod 111 is inserted into rear bushing 113. Respective alignment rods 107, 109 are moved inwardly in direction of arrows 119A, 119B until reduced-diameter rod portion 115 of front alignment rod 107 engages cylindrical aperture 117. In the preferred embodiments, reduced-diameter rod portion 115 and cylindrical aperture 117 are positioned approximately center distance between front mount assembly 401 and rear mount assembly 403. Full engagement of reduced-diameter rod portion 115 and cylindrical aperture 117 indicate proper alignment of scope mounts 401 and 403.

The tolerances of reduced-diameter rod portion 115 and cylindrical aperture 117, as well as the alignment rod-bushing tolerances ensure adequate alignment of mounts 401, 403 when engagement is attained. Proper alignment of mounts 401, 403 will allow mounting of a telescopic sight (not shown) without damage caused by misaligned mounts.

Failure of reduced-diameter rod portion 115 and cylindrical aperture 117 to engage or to engage fully indicate misalignment between front mount 401 and rear mount 403. Observance of reduced-diameter rod portion 115 and cylindrical aperture 117 interference will provide an indication of the direction and amount of misalignment of the mounts. The user may use various mount alignment means such as base 401D, 403D adjustment, or other means such as shims to align mounts 401, 403 sufficiently for full insertion of reduced-diameter rod portion 115 into cylindrical aperture 117.

Figure 4B:
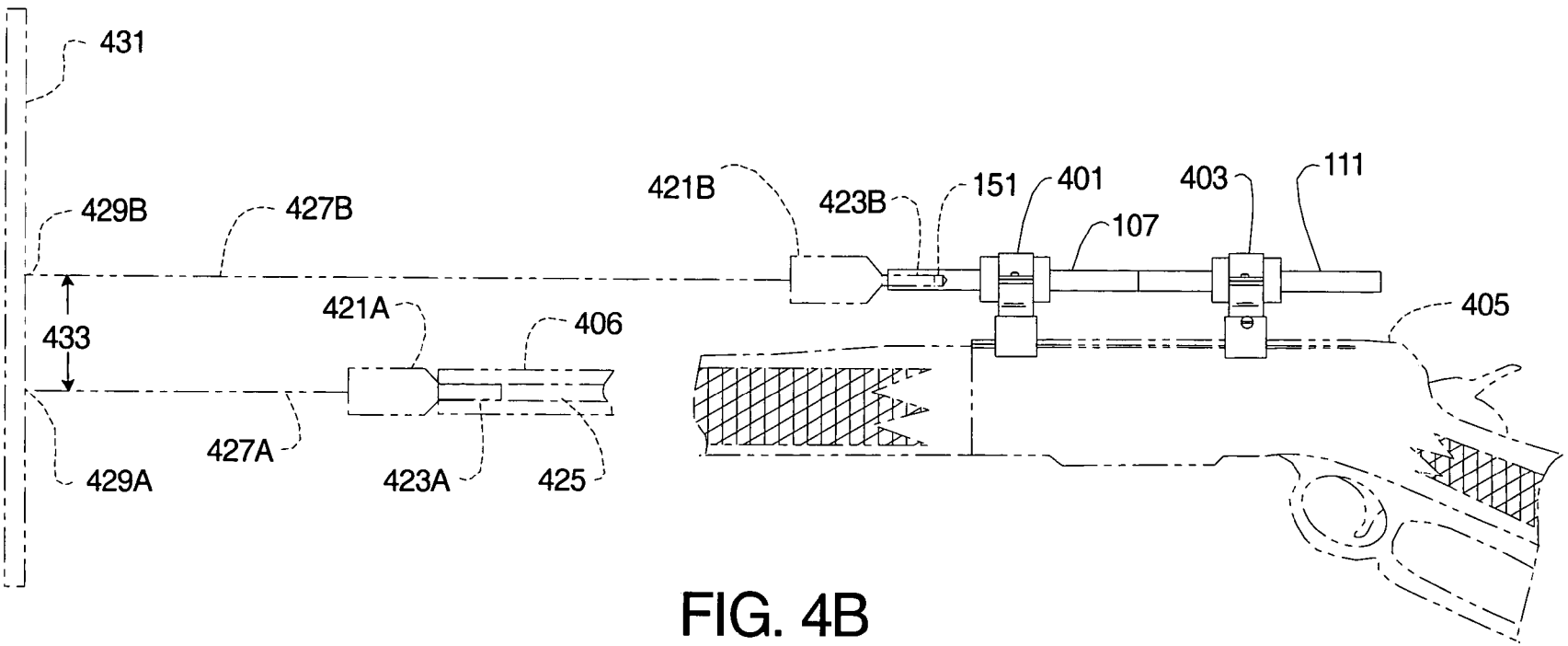
FIG. 4B is a side elevation drawing of the front and back alignment rods engaged as in FIG. 2B and a bore sight apparatus inserted in the bore of the rifle and alignment bore of the front alignment rod for bore sighting the telescopic mounts to the rifle bore.

FIG. 4B is an elevation drawing of an alternative means to align front mount 401 and rear mount 403 to the rifle bore 425 utilizing a bore sight device such as a laser bore sight 421A having an engagement rod 423A inserted in barrel 406 of rifle 405. Bore sight 421A provides a beam 427A axially aligned with bore 425 and provides an indicator point 429A on target 431 with rifle 405 fixed in the position shown. A second bore sight 421B, having an engagement rod 423B and engaged to alignment bore 151 of front alignment rod 107 provides a beam 427B axially aligned with front alignment rod 107 to provide an indicator point 429B on target 431. With front mount 401 and rear mount 403 aligned with alignment bars 107 and 111 engaged as described previously, beam 427B is axially aligned with front mount 401 and rear mount 403.

Measurement of the displacement 433 between indicator points 429AA, 429B provides a means to indicate alignment of the telescopic mounts (front mount 401, rear mount 403) to rifle bore 425. Front mount 401 and/or rear mount 403 may be adjusted to provide the desired vertical and horizontal offsets from the rifle bore. In one embodiment, bore sighting is performed after initial front mount 401 and rear mount 403 alignment as previously described. In another embodiment, bore sighting is done concurrently with front mount/rear mount alignment by maintaining engagement of front alignment rod 107 and rear alignment rod 111 during bore sighting. Final sighting may be done by adjusting telescopic sight crosshair adjustments of the telescopic sight (not shown) upon installation in mounts 401, 403.

In still other embodiments, the same bore sight, for example bore sight 421A, is used in sighting both rifle bore 425 and alignment bore 151 of front alignment rod 107. Use of a standard muzzle diameter for alignment bore 151 facilitates use of the same laser instrument for both applications.

Figure 5A:
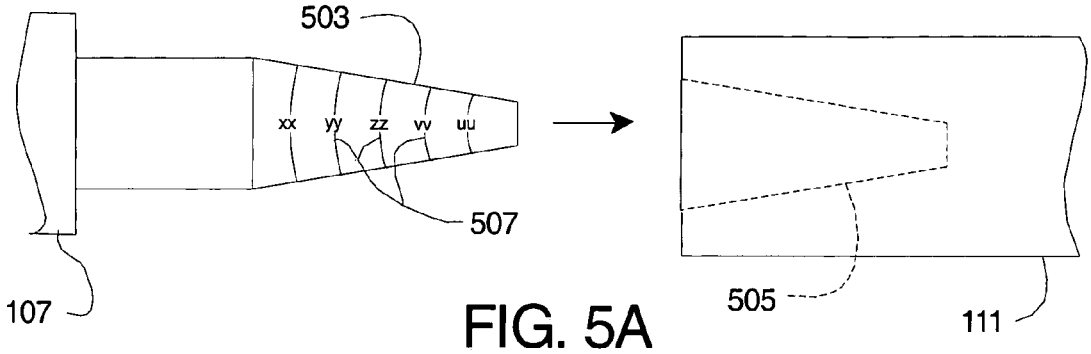
FIG. 5A is a side elevation drawing of an alternative embodiment of the indicator elements of the front and rear alignment rods showing a tapered truncated cone indicator portion and a conical receiving portion.
Figure 5B:
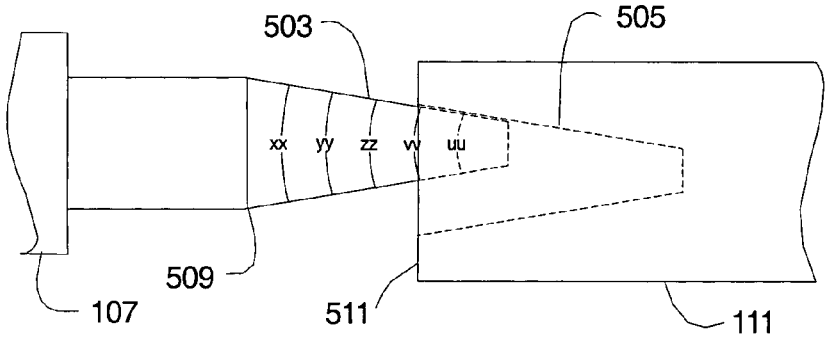
FIG. 5B is a side elevation drawing of the embodiment of FIG. 5A engaged to display a magnitude of misalignment of the front and rear mounts of a firearm.

FIGS. 5A and 5B show an alternative embodiment of alignment indicators for front alignment rod 107 and rear alignment rod 111. Conical indicator portion 503, is substituted for the reduced-diameter rod portion 115 and conical receiving portion 505 is substituted for cylindrical aperture 117 of FIGS. 1-4B. The conical taper of conical indicator portion 503 and conical receiving portion 505 are similar so that full insertion engagement of portions 503 and 505 indicate both angular and offset alignment of the mounts of FIGS. 4A, 4B. Calibrated alignment indicator markings 507 of conical indicator portion 503 provides a means of indicating the amount of misalignment as shown in FIG. 5B. Full insertion of conical indicator portion 503, so that full insertion indicator 509 is aligned with opening 511 of conical receiving portion indicate satisfactory alignment of front mount 401 and rear mount 403 of FIG. 4A.

Figure 5C:
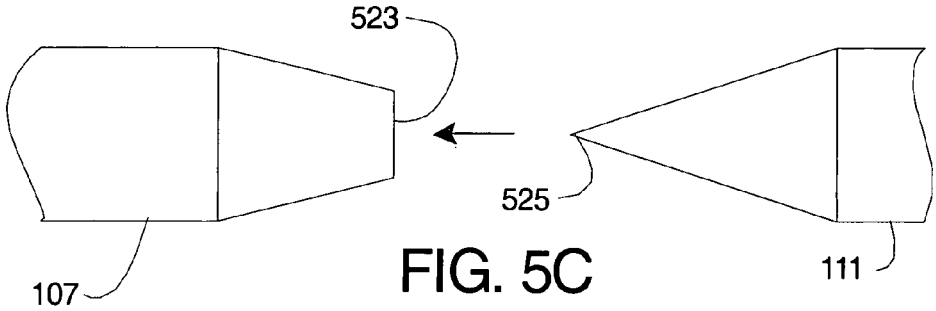
FIG. 5C is a side elevation drawing of an alternative embodiment of the indicator elements of the front and rear alignment rods having a planar portion with an indicator grid on the front alignment rod and a conical pointer on the rear alignment rod.
Figure 5D:
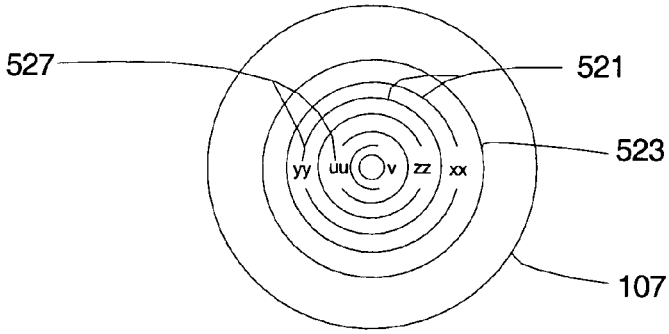
FIG. 5D is an end view of the front alignment rod of the embodiment of FIG. 5C showing the indicator grid.

FIG. 5C shows yet another embodiment of alignment indicators for front alignment rod 107 and rear alignment rod 111. Indicator grid 521 is etched or otherwise marked on planar portion 523 of front alignment rod 107. When conical tip 525 of rear indicator rod 111 is moved into contact with planar portion 523, the location of tip 525 on indicator grid 521 provides a means to measure misalignment of front mount 401 and rear mount 403 of FIG. 4A. Calibrated markings 527 provide a means to quantify misalignment of the mounts.

In the preferred embodiment, the alignment rods and bushings of the alignment device are machined from stainless steel rod. In other embodiments, the parts are made of other metals such as carbon steel, brass or aluminum. In still other embodiments, the parts of the device are made from plastic or composite materials. In the preferred embodiments, a second set of bushings 109, 113 is supplied with the device. The second set of bushings is identical with the first set except the outside diameter (109B of FIG. 3A) is selected to fit another standard inner diameter of telescopic sight mount rings. The second set of bushings allows the front and rear alignment rods to be used with the second set of bushings for a different sized scope mount.

Although the description above contains many specifications, these should not be construed as limiting the scope of the invention but merely providing illustrations of some of the presently preferred embodiments of this invention. For example, the front and rear alignment rods may be reversed, or bar lock devices may be added to the apparatus. Thus the scope of the invention should be determined by the appended claims and their legal equivalents, rather than by the examples given.

I claim:

1. An alignment device for a firearm telescopic sight mount comprising a first mount assembly and a second mount assembly, the alignment device comprising:

a first alignment bushing attachable to said first mount assembly of said telescopic sight mount, said first bushing comprising an outer diameter chosen to be clampable in an inner, diameter of a ring clamp portion of said first mount assembly;

a first alignment rod comprising a first close sliding fit between said first bushing and a first engageable surface of said first rod, said close first sliding fit comprising a diametrical clearance greater than zero and less than 0.0020 inches between an inner diameter of said first alignment bushing and an outer diameter of said first engageable surface of said first rod and a first alignment indicator element disposed on a first end of said first alignment rod; and a second alignment rod engageable with said second mount assembly of said telescopic sight mount and comprising a second alignment indicator element engageable with said first alignment indicator element;

wherein sliding said first alignment rod towards said second alignment rod engages said first alignment indicator element and said second alignment indicator element to determine alignment of said first mount assembly and said second mount assembly.

2. The alignment device of claim 1 comprising a second alignment bushing attachable to said second mount assembly of said telescopic sight mount and said second alignment rod comprises a second close sliding fit between said second bushing and a second engageable surface of said second alignment rod.

3. The alignment device of claim 2 wherein said first close sliding fit is a sliding fit between an inner diameter of said first bushing and an outer diameter of said first alignment rod and said second close sliding fit is a sliding fit between an inner diameter of said second bushing and an outer diameter of said second alignment rod.

4. The alignment device of claim 1 wherein said first alignment indicator is a male engagement element and said second alignment indicator is a female engagement element engageable with said male engagement element.

5. The alignment device of claim 4 wherein said male engagement element is a reduced-diameter cylindrical portion and said female engagement element is a cylindrical aperture having a close fit with said reduced-diameter cylindrical portion.

6. The alignment device of claim 4 wherein said male engagement element is a tapered portion comprising a surface having a first taper and said female engagement portion comprises an aperture comprising a second taper.

7. The alignment device of claim 6 wherein said first taper and said second taper are the same tapers.

8. The alignment device of claim 7 wherein said male engagement portion comprises a calibration marking indicating a misalignment of said first mount assembly and said second mount assembly.

9. The alignment device of claim 1 wherein said first close sliding fit is less than 0.0015 inches on the diameter.

10. The alignment device of claim 1 wherein said first sliding fit is less than 0.0010 inches on the diameter.

11. The alignment device of claim 1 wherein said first alignment rod comprises a bore sight attachment element on a second end of said first alignment rod.

12. The alignment device of claim 11 wherein said bore sight attachment element is a bore aperture compatible with standard firearm bore dimensions.

13. The alignment device of claim 1 wherein said first alignment indicator is a generally planar surface comprising a plurality of circular alignment rings and said second alignment indicator is a generally conical element comprising a pointed tip.

14. An alignment device for a firearm telescopic sight mount comprising a first mount assembly and a second mount assembly, the alignment device comprising:

a first alignment bushing attachable to said first mount assembly of said telescopic sight mount;

a first alignment rod comprising a close sliding fit between said first bushing and said first alignment rod and a first alignment indicator comprising a first male engagement element on a first end of said first alignment rod; and a second alignment rod engageable with said second mount assembly of said telescopic sight mount and comprising a second alignment indicator comprising a female engagement element on a first end of said second alignment rod;

wherein sliding said first alignment rod towards said second alignment rod resulting in engagement of said male engagement element and said female engagement element indicates acceptable alignment of said first mount assembly and said second mount assembly.

15. The alignment device of claim 14 comprising a second alignment bushing attachable to said second mount assembly and wherein said second alignment rod comprises a close sliding fit with said second bushing wherein both said first alignment rod and said second alignment rod are slideable towards each other.

16. The alignment device of claim 14 wherein said male engagement element is a cylindrical rod portion and said female engagement element is a cylindrical aperture comprising a close sliding fit with said male engagement element.

17. The alignment device of claim 14 wherein said male engagement element comprises a conical projecting portion and said female engagement element comprises a conical aperture portion.

18. The alignment device of claim 14 wherein said first alignment rod comprises a bore sight attachment element on a second end of said first alignment rod.

19. A method for aligning a first ring clamp and a second ring clamp of a telescopic mount of a firearm, the method comprising the steps:

clamping a first alignment bushing in said first ring clamp, said first alignment bushing comprising an outer diameter chosen to be clampable in an inner diameter of said first ring clamp of said telescopic mount;

inserting a first alignment rod comprising a close sliding fit with said first bushing into said first bushing, said first alignment rod comprising a first engageable indicator portion on a first end of said first alignment rod;

attaching a second alignment rod to said second ring clamp, said second alignment rod comprising a second engageable indicator portion; and sliding said first alignment rod towards said second alignment rod wherein insertion of said first indicator portion into said second indicator portion indicates acceptable alignment of said first ring clamp and said second ring clamp of said telescopic mount.

20. The method of claim 19 wherein said first indicator portion is a male coupling element and said second indicator portion is a female indicator portion.

21. The method of claim 19 comprising additional steps of inserting an optical alignment device into a bore on said first alignment rod and projecting a first beam to a target.

22. The method of claim 21 comprising additional steps of attaching a bore sight apparatus to a rifle bore of said firearm and projecting a second beam from said rifle bore to said target.

* * * * *